US008068066B2

(12) United States Patent
Perkins, III

(10) Patent No.: US 8,068,066 B2
(45) Date of Patent: Nov. 29, 2011

(54) X-BAND TURNSTILE ANTENNA

(75) Inventor: Thomas O Perkins, III, Bedford, NH (US)

(73) Assignee: BAE Systems Information and Electronic Systems Integration Inc., Nashua, NJ (US)

( * ) Notice: Subject to any disclaimer, the term of this patent is extended or adjusted under 35 U.S.C. 154(b) by 665 days.

(21) Appl. No.: 12/197,456

(22) Filed: Aug. 25, 2008

(65) Prior Publication Data

US 2010/0171590 A1 Jul. 8, 2010

(51) Int. Cl.
*H01Q 21/26* (2006.01)

(52) U.S. Cl. ..... 343/797; 343/820

(58) Field of Classification Search ..... 343/797, 343/820

See application file for complete search history.

(56) References Cited

U.S. PATENT DOCUMENTS 3,093,825 A * 6/1963 Allen ..... 342/363
4,446,465 A * 5/1984 Donovan ..... 343/797
6,342,867 B1 * 1/2002 Bell ..... 343/795
6,344,833 B1 * 2/2002 Lin et al. ..... 343/846
2002/0050828 A1 5/2002 Seward, IV et al.
2005/0110691 A1 5/2005 Anderson
2008/0136721 A1 6/2008 Parsche et al.

OTHER PUBLICATIONS

PCT Search Report dated Apr. 29, 2010 of Patent Application No. PCT/US2009/004739 filed Aug. 20, 2009.

Thompson, Michael C., "2 Meter Turnstile Antenna for Amateur Satellite Communication" [online] [retrieved on Apr. 26, 2007] Retrieved from the internet <URL: http://www.wb8erj.com/turnstile_antenna.htm>.

* cited by examiner

*Primary Examiner* — Hoang V Nguyen
(74) *Attorney, Agent, or Firm* — Vern Maine & Associates; David A. Rardin

(57) ABSTRACT

An X-band, crossed dipole turnstile antenna configured to be omni-directional with horizontal polarization is disclosed. It comprises a set of two dipole antennas aligned at right angles to each other attached to a common 50 ohm coaxial feedpoint and fed 90 degrees out-of-phase. The antenna pattern is nearly omnidirectional in the horizontal plane. The antenna can be used generally in microwave communications including Digital Radio Frequency Tags (DRaFTs) communicating with airborne and satellite platforms.

20 Claims, 13 Drawing Sheets

400

700

1000

1300

X-BAND TURNSTILE ANTENNA

STATEMENT OF GOVERNMENT INTEREST

Portions of the present invention were made in conjunction with Government funding under contract number W15P7T-06-C-P422 giving certain rights to the Government.

FIELD OF THE INVENTION

This invention relates to microwave antennas and, more particularly, to the utilization of a crossed dipole turnstile antenna configured to be omni-directional with horizontal polarization.

BACKGROUND OF THE INVENTION

Radio frequency communication with air and space platforms provides the opportunity to remotely track objects over large distances. Military operations especially have a need for tracking technology for air-to-ground Combat Identification (CID). This generally includes microwave communications. As an example, a Digital Radio Frequency Tag (DRaFT) can provide flexible, low cost technology to allow radars such as Moving Target Indicator (MTI) and Synthetic Aperture Radar (SAR) to receive data from ground devices. These small, lightweight and affordable RF Tags provide for data extraction from unattended ground sensors and communication with vehicles and personnel throughout an area. This is particularly useful for the identification and location of combined units. Other advanced tag functions include additional communications capabilities for enhanced interoperability with identification and communications systems. These can give the tags dual-mode capability to function as a tag when radar is present or as a more conventional radio beacon device when radar is not available. Another application includes dual-mode tags communicating with Satellite Communication (SATCOM) platforms. Additionally, small-scale tag variations may support other target tracking, substantially enhancing situational awareness and asset identification for ground operations. Tag antenna characteristics include horizontal polarization required to communicate with airborne radar platforms having horizontal (azimuth) polarization. Linear and circular polarization can be employed. Antennas presently used for DRaFTs are very large, waveguide slot antennas. They are typically 7 inches long, 1 inch wide and 0.5 inch deep. What is needed, therefore, are small, inexpensive antennas with horizontal polarization and an omni-directional pattern.

SUMMARY OF THE INVENTION

The above problems of waveguide slot antennas are solved by providing a crossed dipole, turnstile antenna over a ground plane. Advantages of the new antenna are that it is small, very inexpensive, omni-directional, and can be built using microwave integrated circuit assembly tools.

The antenna is capable of communicating with loitering platforms, has linear horizontal polarization and is able to handle up to 2 watts continuous wave (CW) power over the frequency of interest. Bi-directional communication is supported with a radiation pattern having transmit/receive reciprocity. It is omnidirectional in azimuth, with wobble less than or equal to 1 dB and an elevation gain of +3 dBi at 45 degrees of elevation. It has small size and light weight.

The invention can be applied to Digital Radio Frequency Tags (DRaFT). It can also be used in other microwave communication systems including but not limited to radios and direction finding equipment.

Embodiments of the invention include a horizontally polarized microwave turnstile antenna comprising a ground plane and a pair of crossed dipole elements having a spacing from the ground plane and the elements fed 90 degrees out of phase. The antenna radiation polarization can be horizontal and the antenna can provide transmit and receive reciprocity. The radiation pattern can be substantially omnidirectional in the plane of the ground plane. The radiation pattern can be circularly polarized. In embodiments, the antenna radiation frequency is in the X-band. The antenna resonant frequency can be 9.5 GHz to 9.8 GHz. For embodiments, the spacing from the ground plane is one-half wavelength. This spacing from the ground plane can be 0.611 inch. For embodiments, the length of the crossed dipole elements is one-half wavelength. For certain embodiments, the length of the crossed dipole elements is 0.7 inch and the ground plane is a copper disk. In another embodiment, the ground plane is proximate a skirt. In yet other embodiments, the ground plane diameter is 1.4 inches. For embodiments, the length of the U-shaped piece of coaxial cable between the two dipoles is selected to produce circularly polarized (CP) radiation.

Yet further embodiments include a horizontally polarized X-band turnstile antenna comprising a 1.4 inch diameter copper ground plane proximate a skirt, a pair of crossed dipole elements 0.6375 inch long having a spacing 1.155 inches from the ground plane opposite the skirt, the dipole elements having 90 degree phasing, and a 0.66 inch long segment of U-shaped coaxial cable in electrical connection between the dipole elements.

Other embodiments include a microwave frequency tag comprising an antenna comprising a ground plane, a pair of crossed dipoles spaced from the ground plane and having 90 degree phasing, and circuitry in electrical communication with the antenna wherein the microwave frequency tag communicates with a transceiver. For embodiments, the microwave frequency tag is associated with personnel or vehicles. In yet other embodiments, the microwave frequency tag is a digital radio frequency tag (DRaFT).

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
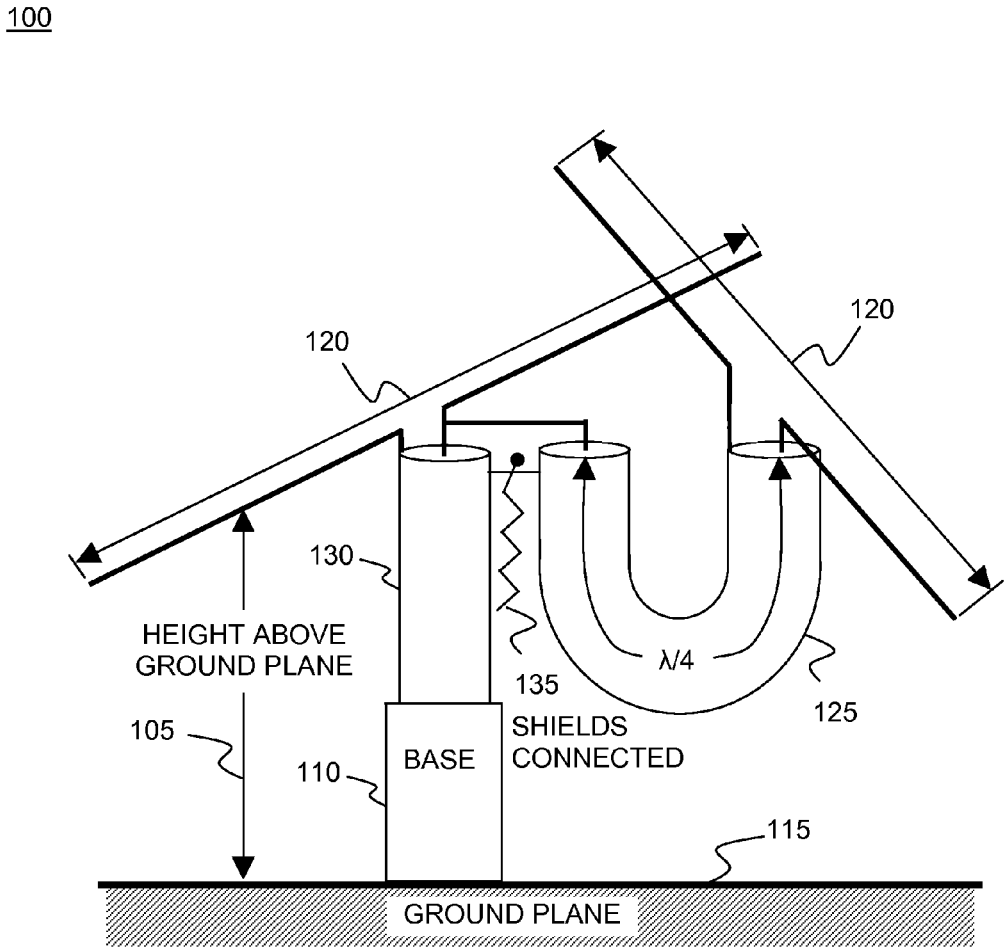
FIG. 1 is a simplified schematic illustration of the subject antenna configured in accordance with one embodiment of the invention.

A turnstile antenna is a set of two dipole antennas aligned at right angles to each other attached to a common 50 ohm coaxial feedpoint and fed 90 degrees out-of-phase. The name reflects that the antenna looks like a turnstile when mounted horizontally. When mounted horizontally, the antenna is nearly omnidirectional on the horizontal plane. When mounted vertically, the antenna is directional to a right angle to its plane. In embodiments of the present application, the antenna can be used generally for microwave communications. In particular embodiments, the antenna can be mounted on a vehicle or personnel-carried tag and communicate with a horizontally polarized antenna on an aircraft.

In embodiments, tiny semirigid coaxial cable was used to create the feed and 90 degree phasing. This was at a high frequency (near 10 GHz). The groundplane spacing is important at X-band (and microwave frequencies in general) as are the dipole elements themselves.

Embodiments of the antenna work cooperatively with loitering airborne platforms. Aircraft are typically within 135 nautical miles, line of sight (L.O.S.). The resonant frequency range is 9.5 to 9.8 GHz with linear horizontal polarization and an impedance of 50 ohms. Other attributes include a voltage standing wave ratio (VSWR) less than 1.5:1, a return loss of less than 14 dB, and the ability to handle up to 2 watts (+33 dBm) CW. The radiation pattern has transmit/receive reciprocity supporting bidirectional communication and is omni directional in azimuth with wobble less than 1 dB. Elevation gain is +3 dBi at 45° elevation and radiation efficiency is 92%, with total efficiency of 80%. In embodiments, the ground plane spacing is approximately 0.600 inch. An exemplary connector is a SubMiniature version A (SMA) type. Size and weight are preferably less than 0.5 cubic inch and 1 ounce, respectively.

Antenna embodiments include a manufactured device, a computer simulation of the electrical characteristics of the antenna, and two computer models employing the physical attributes of the turnstile antenna.

FIG. 1 is a simplified schematic illustration 100 of an embodiment of a horizontal-polarization turnstile antenna. It depicts height above ground plane (HAGP) 105, and general components of the antenna. The component orientations are illustrative and not to scale. In this embodiment, the resonant frequency is 9.65 GHz, with $\lambda$=1.223 inch, $3\lambda/4$=0.9173", and $\lambda/2$=0.611". Base 110, an SMA male connector, is attached to ground plane 115. Element lengths 120 are each 0.6115 inch. A u-shaped segment 125 is nominally a 75 ohm, ¼ wave, length of coaxial cable. The length of the 75 ohm coaxial cable segment would be L=11,803 (velocity factor) (0.25)/9,650 MHz. For example, using RG 179 with a solid Teflon® dielectric, L=11,803(0.69) (0.25)/9,650 MHz=0.210"=$\lambda/4$. Teflon® is a registered trademark of E.I. du Pont de Nemours and Company Corporation. Note that variations on the coaxial cables are possible, with calculations based on parameters such as dielectric constant, velocity factor of other cable selections. Shields of the u-segment 125 and vertical segment 130 are electrically connected 135. This embodiment employs very small diameter coaxial cable components.

Figure 2:
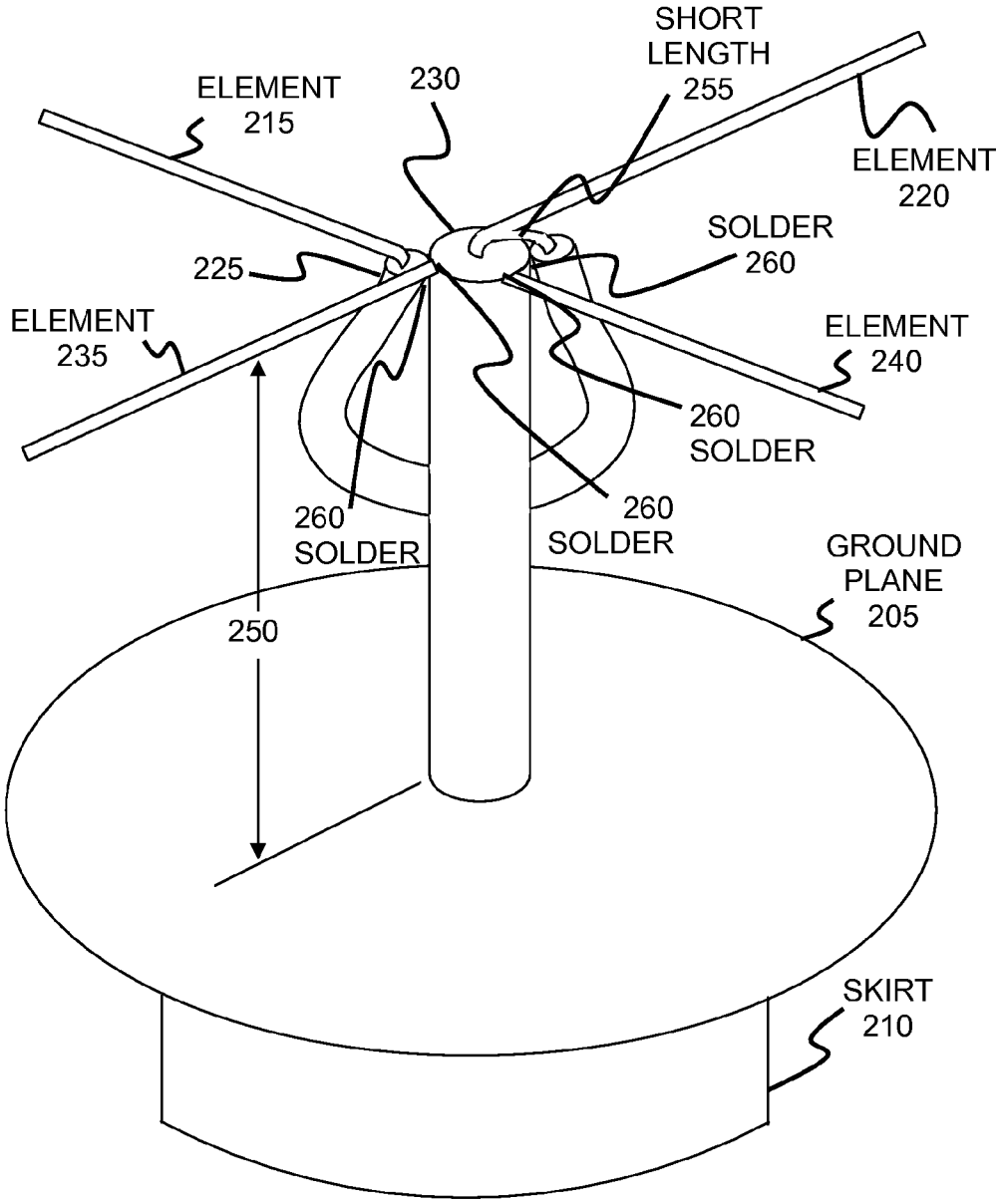
FIG. 2 is a simplified perspective diagrammatic illustration of a turnstile antenna showing a ground plane and skirt configured in accordance with one embodiment of the present invention.

FIG. 2 is a simplified diagrammatic perspective illustration 200 of the dimensions and configurations of an embodiment of a turnstile antenna showing a circular ground plane 205 and skirt 210. Elements 215 and 220 are continuations of center conductors of coaxial segments 225 and 230, respectively. Elements 235 and 240 may be center conductors from coaxial segments. Element are preferably of similar diameter to benefit the capture area or effective aperture. In embodiments, u-shaped segment 225 is 0.660" long. Dipole element lengths 215, 220, 235, and 240 are 0.700". Height above ground plane (HAGP) 250 is 0.611". There is a 90 degree angle between elements 215, 220, 235, and 240. U-shaped (nominally) 70 Ohm coaxial segment 225 center conductor to element 240 distance 255 should be as short as possible. Elements and shields are soldered at points 260. Other forms of electrical connection than soldering may be used. Copper disk ground plane 205 may have a 1.4 inch diameter and a hole in the center. Ground plane diameter may vary, for example, being larger than 1.4 inches. Optionally, the ground plane may rest on a flared and soldered skirt 210. Skirt 210 is optional and may be a portion of an SMA connector, for example.

Figure 3:
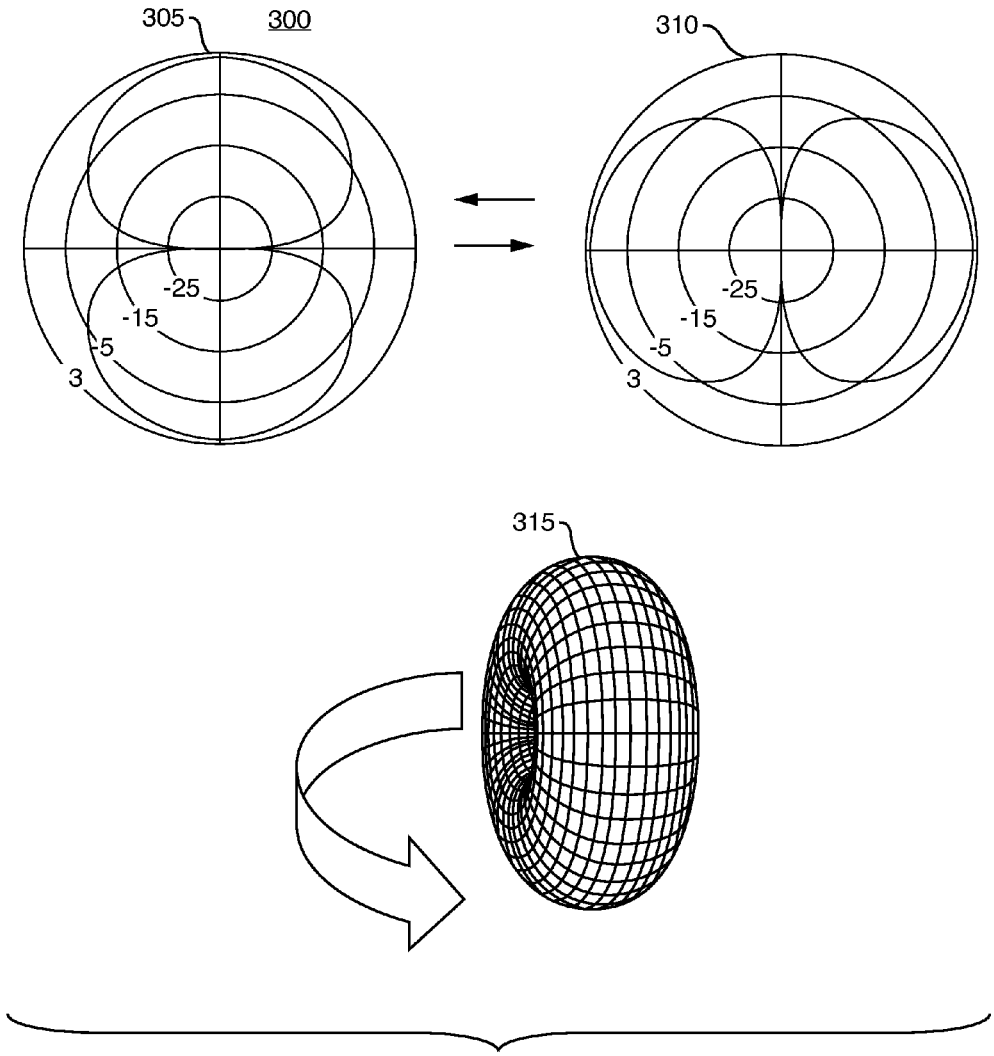
FIG. 3 is a plot of an overlay of two horizontal-polarization dipoles demonstrating a turnstile antenna pattern.

FIG. 3 is a plot 300 of an overlay 315 of two horizontal-polarization dipoles 305, 310 demonstrating a turnstile antenna pattern.

Figure 4:
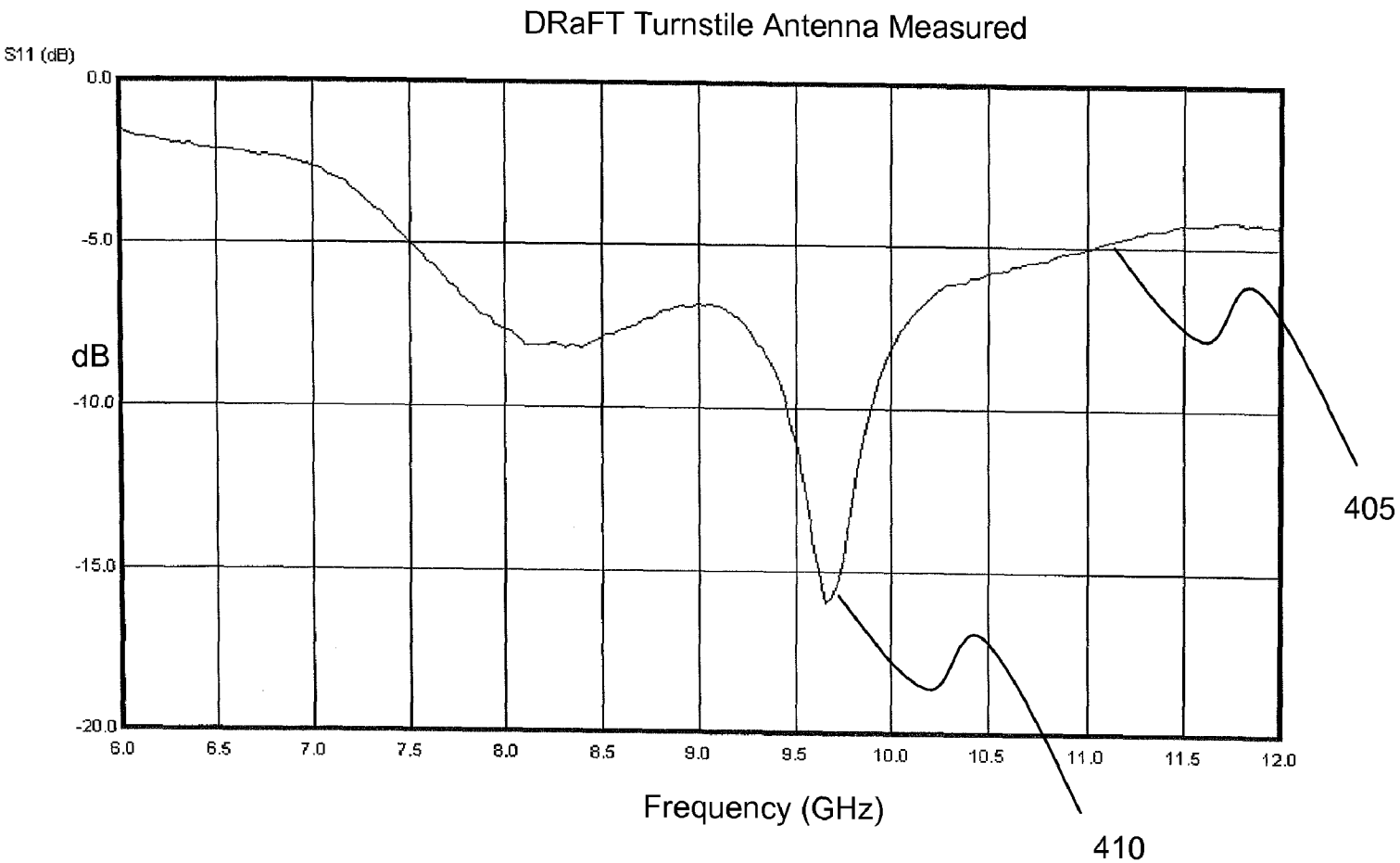
FIG. 4 is a graph of the measured return loss of the turnstile antenna of FIG. 2 in the range of 6 to 12 GHz between 0 and −20 dB.

FIG. 4 is a graph 400 of the measured return loss of the turnstile antenna of FIG. 2 showing a return loss equal to −16 dB 405 with a 1.38:1 VSWR.

Figure 5:
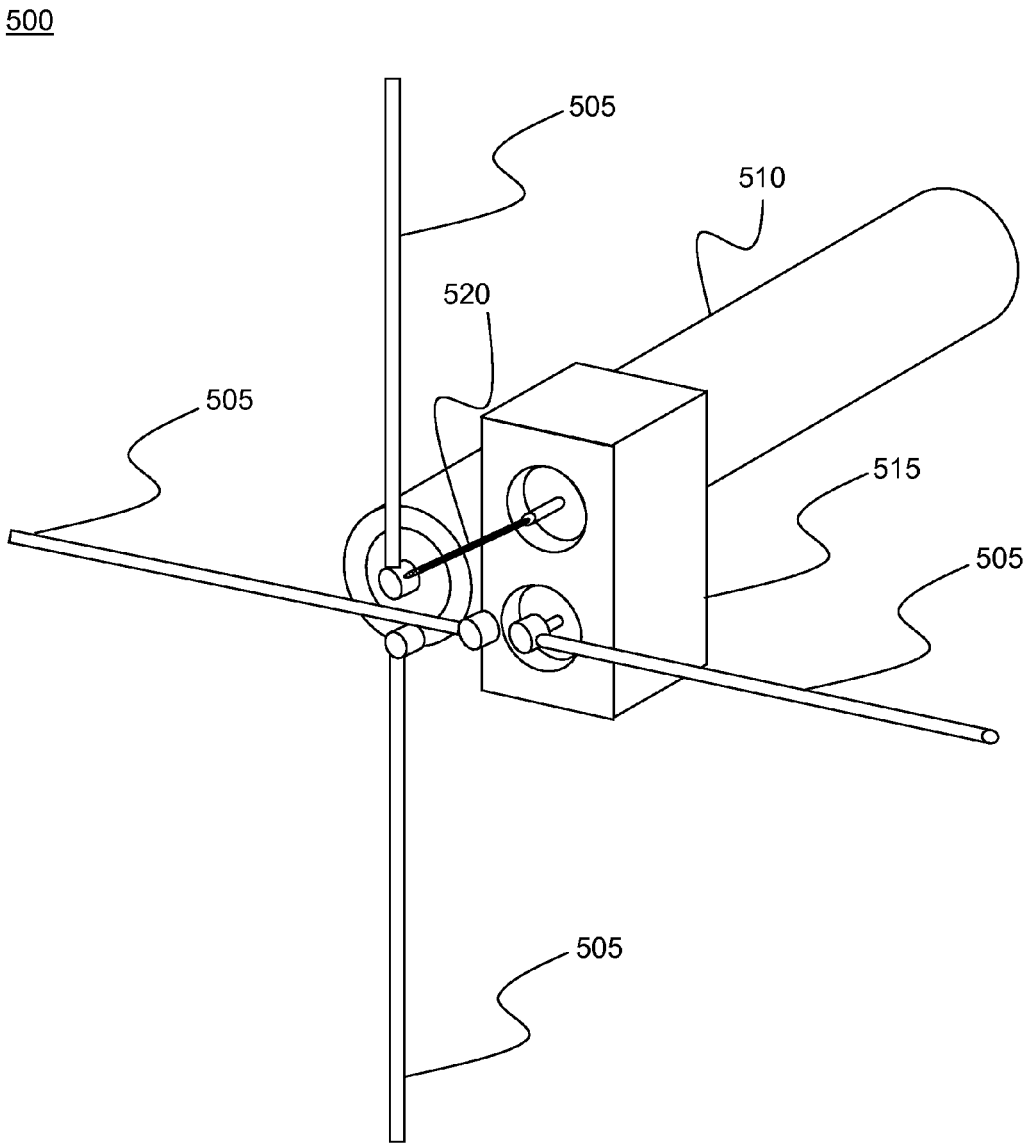
FIG. 5 is a diagrammatic illustration of a simulated antenna configured in accordance with one embodiment of the invention.

FIG. 5 is a diagrammatic illustration 500 of a simulated antenna configured in accordance with one embodiment of the invention. The simulation is of a pair of crossed dipoles 505 fed by and supported by a one-half wavelength coaxial line 510 over a finite ground in the microwave band. There is a short U-shaped piece of coax 515 between the two dipoles. In embodiments, this length is set to give circularly polarized (CP) radiation, although it is not optimized in this simulation model. One center conductor of segment 515 is in electrical connection 520 with the center conductor of coaxial segment 510.

Figure 6:
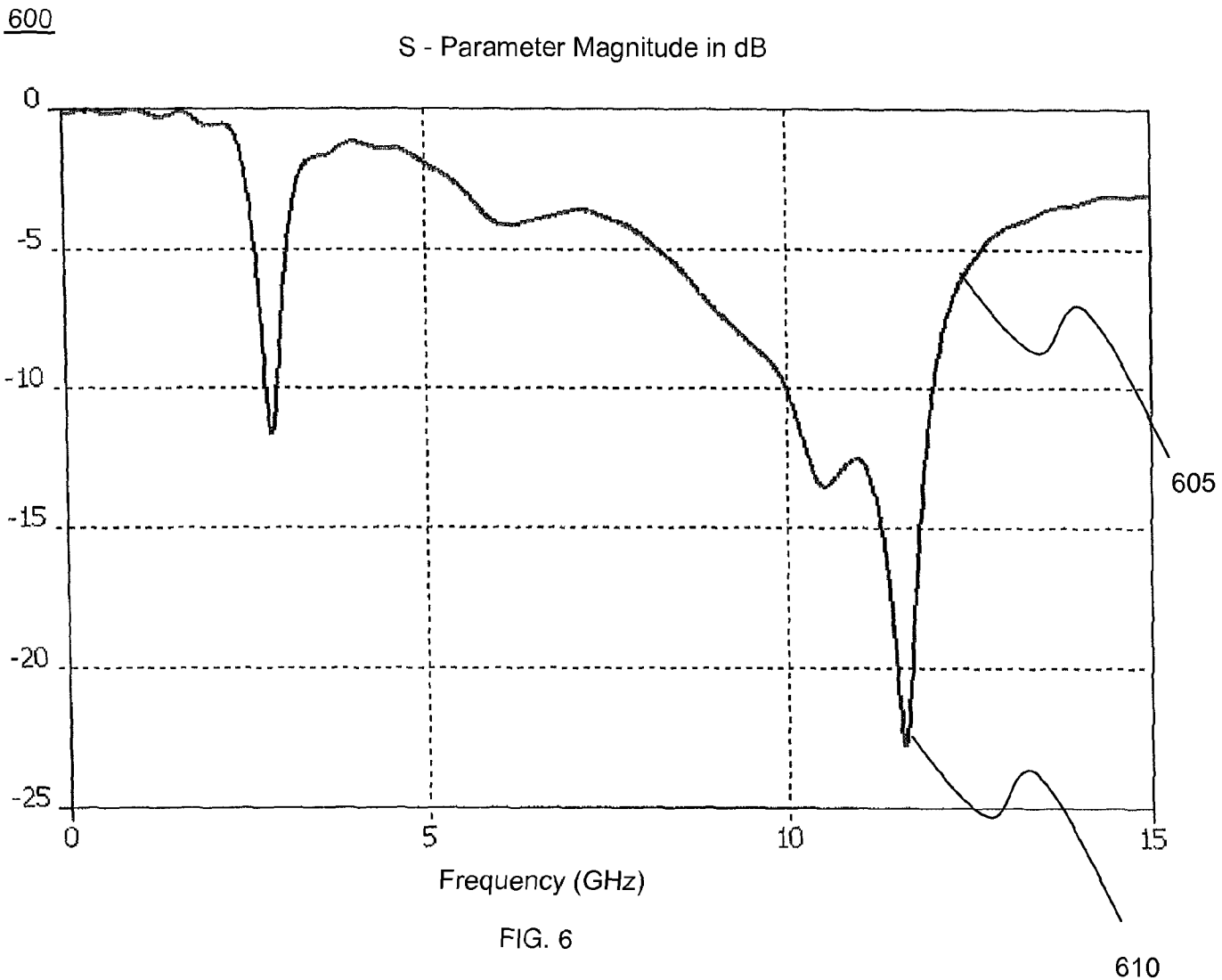
FIG. 6 is a graph of the return loss of the simulation of a turnstile antenna configured in accordance with one embodiment of the invention.

FIG. 6 is a graph 600 of the S-Parameter Magnitude in dB from 0 to 15 GHz. 605 of the simulation of FIG. 5. The design frequency of the simulation was 9.65 GHz, but S11 has a minimum 610 at higher frequency, approximately 11.5 GHz. This indicates that the antenna can be built to operate over a wider range of frequencies than anticipated.

Figure 7:
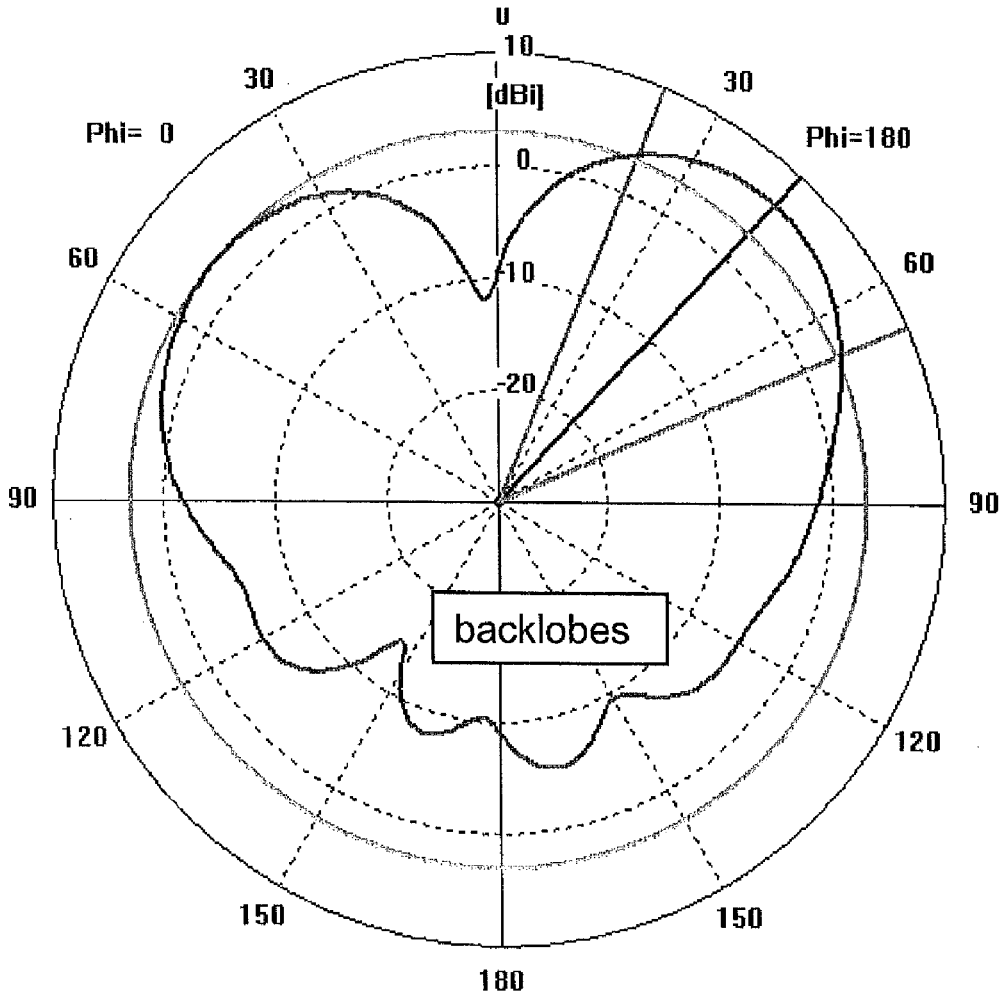
FIG. 7 is a polar plot of the antenna pattern of the simulation of a turnstile antenna represented in FIG. 5.

FIG. 7 is a farfield polar plot 700 of the antenna pattern of the simulation in FIG. 5. It represents phi=180 degrees. The radiation efficiency is 0.9445, total efficiency is 0.8184, and directivity is 7.296 dBi. The beam peaks 43 degrees off the normal to the ground. The beam on the opposite side of the coaxial cable peaks 3.5 dB down. Radiation is above the ground plane with phi−180. The main lobe magnitude is 6.6 dBi with a direction of 43.0 degrees and an angular width (3 dB) of 43.9 degrees. The side lobe level equals −3.5 dB. In three dimensions, the pattern exhibits effects of the finite ground and the tip of the coax feed at 9.65 GHz. The radiation peaks off-axis and to the side. Adjusting the length of the U-bend section can influence the peak to be less phi-dependent.

Figure 8:
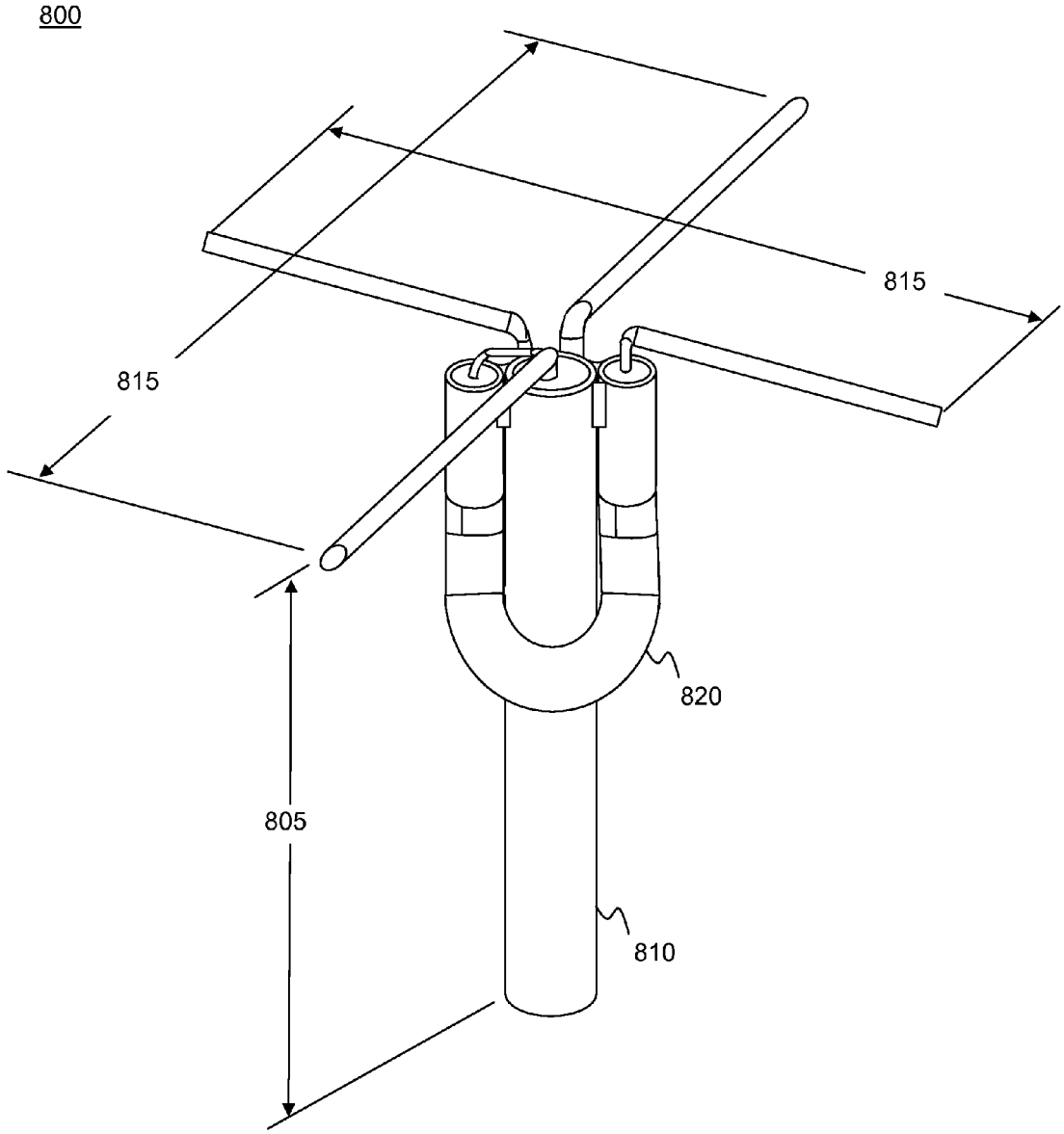
FIG. 8 is a diagrammatic illustration of the subject antenna with a height above ground plane (HAGP) of 611 mil. configured in accordance with one embodiment of the invention.

FIG. 8 is a diagrammatic illustration 800 of a physical model depiction of the subject antenna with a height above ground plane (HAGP) 805 of 611 mil. configured in accordance with one embodiment of the invention. Characteristics include a vertical center segment 810 of 50 ohm coaxial cable with an outer conductor diameter of 86.5 mil., a dielectric diameter of 66 mil., a center conductor diameter of 20.1 mil., a dielectric constant of 2.1, and conductivity of 3e7 S/m. The dipole length 815 is 700 mil. for this embodiment. The U-shaped segment 820 of 70 ohm coaxial cable has an outer conductor diameter of 47 mil., a dielectric diameter of 37.5 mil. a center conductor diameter of 7.1 mil., a dielectric constant of 2.1, and a conductivity of 3e7 S/m. The U-shaped segment length 820 is 660 mil.

Figure 9:
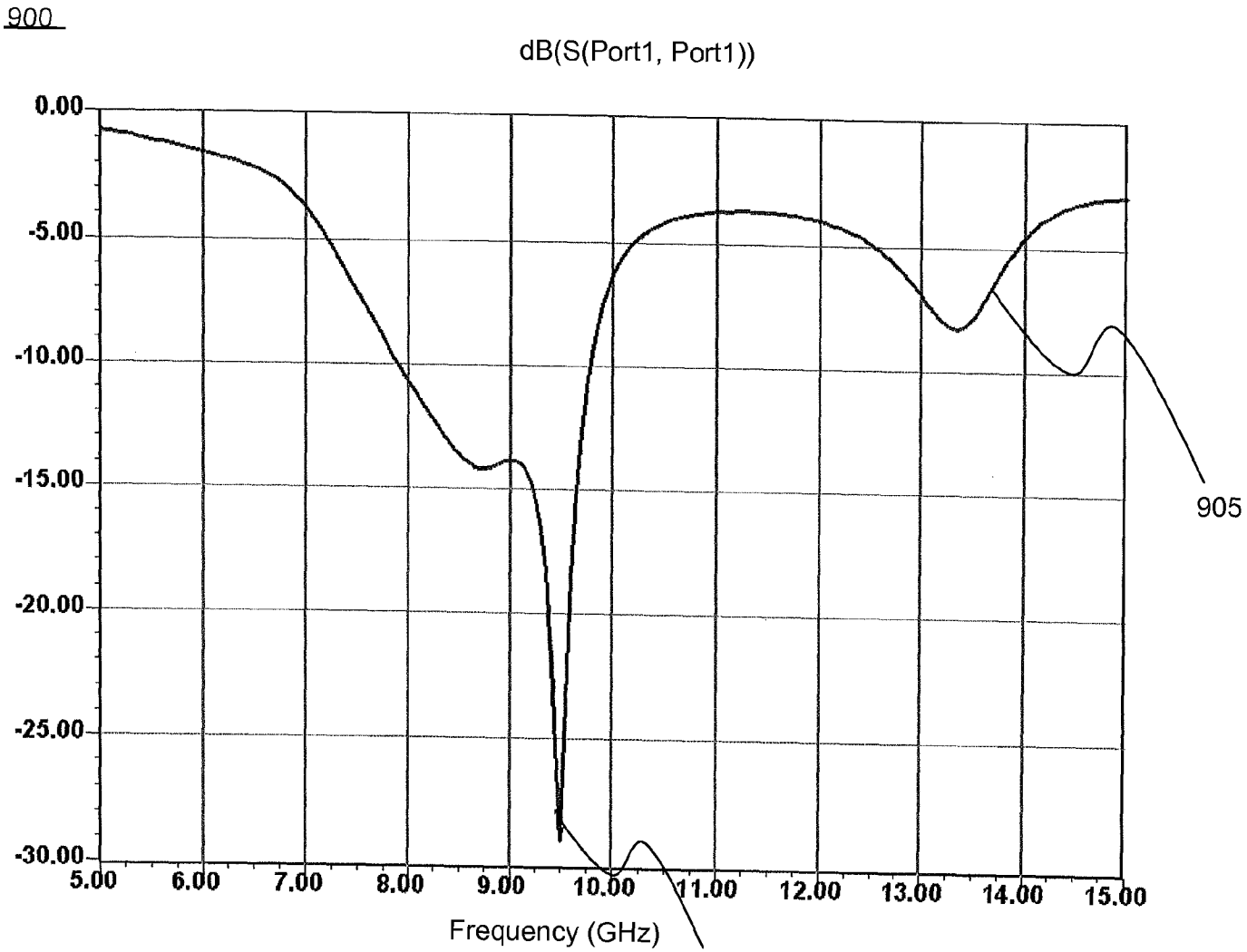
FIG. 9 is a graph of the modeled return loss of the turnstile antenna of FIG. 8.

FIG. 9 is a graph 900 of the modeled return loss of the antenna of FIG. 8. It is a plot 905 of dB(S(Port1, Port1)) over 5 to 15 GHz. Datapoint 910 is at 9.50 GHz and −28.96 dB.

Figure 10:
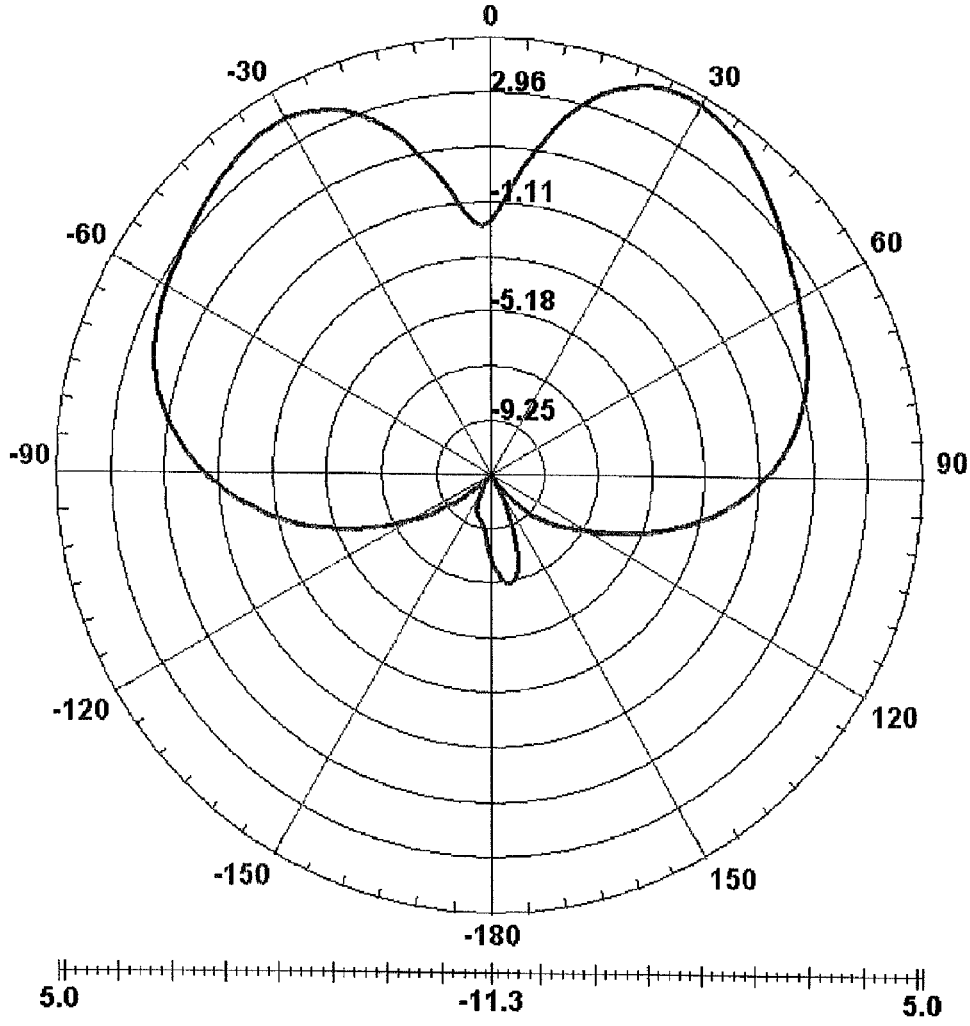
FIG. 10 is a polar plot of the antenna pattern for the antenna of FIG. 8.

FIG. 10 is a polar plot 1000 of the pattern for the antenna embodiment of FIG. 8. It displays a farfield directivity radiation pattern for a frequency of 9.65 GHz, and phi=90 degrees.

Figure 11:
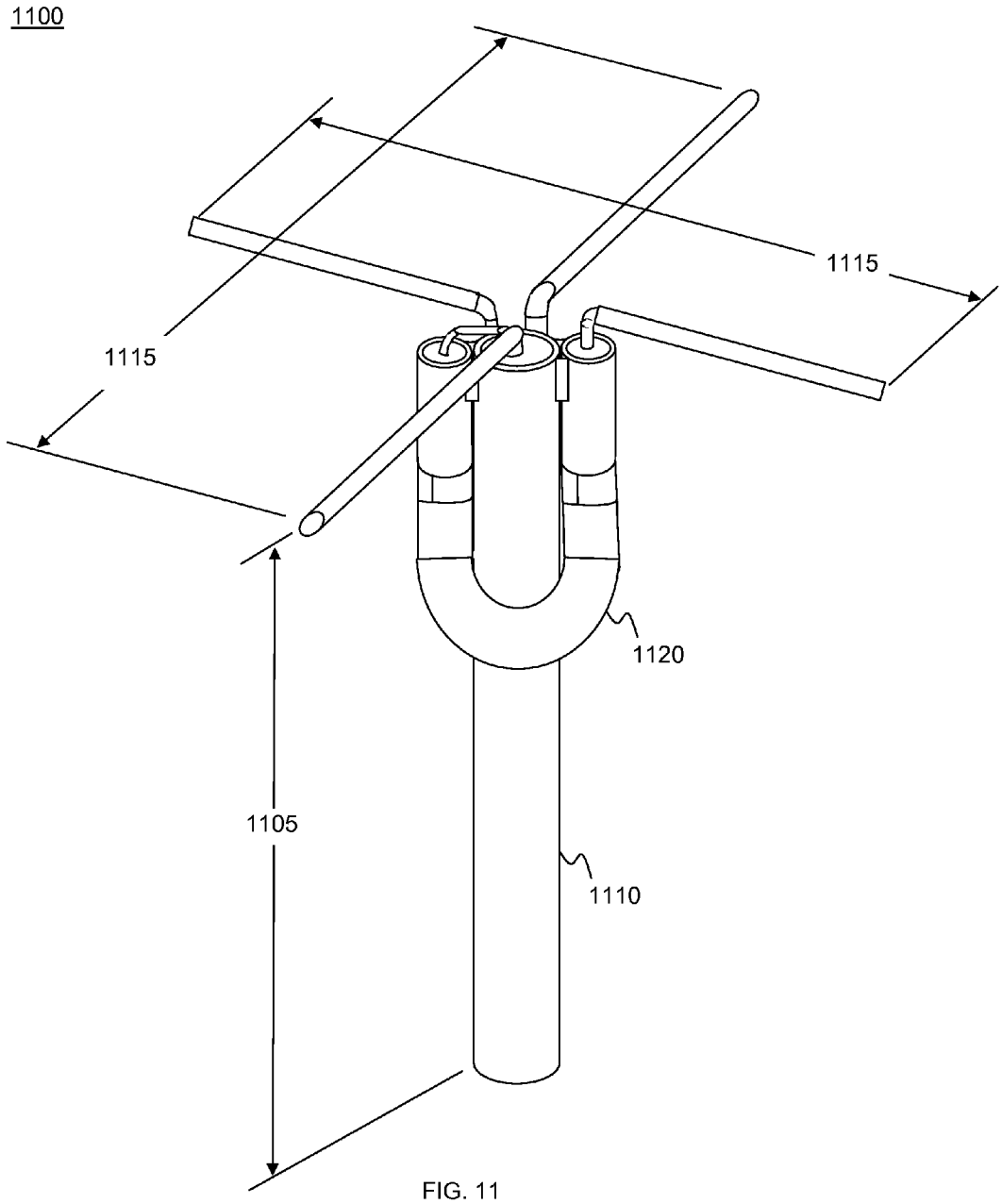
FIG. 11 is a diagrammatic illustration of the subject antenna with a height above ground plane (HAGP) of 1,155 mil. configured in accordance with one embodiment of the invention.

FIG. 11 is a diagrammatic illustration 1100 of a physical model depiction of the subject antenna with a height above ground plane 1105 (HAGP) of 1,155 mil. configured in accordance with one embodiment of the invention. Characteristics include a vertical center segment 1110 of 50 ohm coaxial cable with an outer conductor diameter of 86.5 mil., a dielectric diameter of 66 mil., a center conductor diameter of 20.1 mil., a dielectric constant of 2.1, and conductivity of 3e7 S/m. The dipole length 1115 is 637.5 mil. for this embodiment. As in FIG. 8's embodiment, the U-shaped segment 1120 of 70 ohm coaxial cable has an outer conductor diameter of 47 mil., a dielectric diameter of 37.5 mil. a center conductor diameter of 7.1 mil., a dielectric constant of 2.1, and a conductivity of 3e7 S/m. The U-shaped segment 1120 length is 660 mil.

Figure 12:
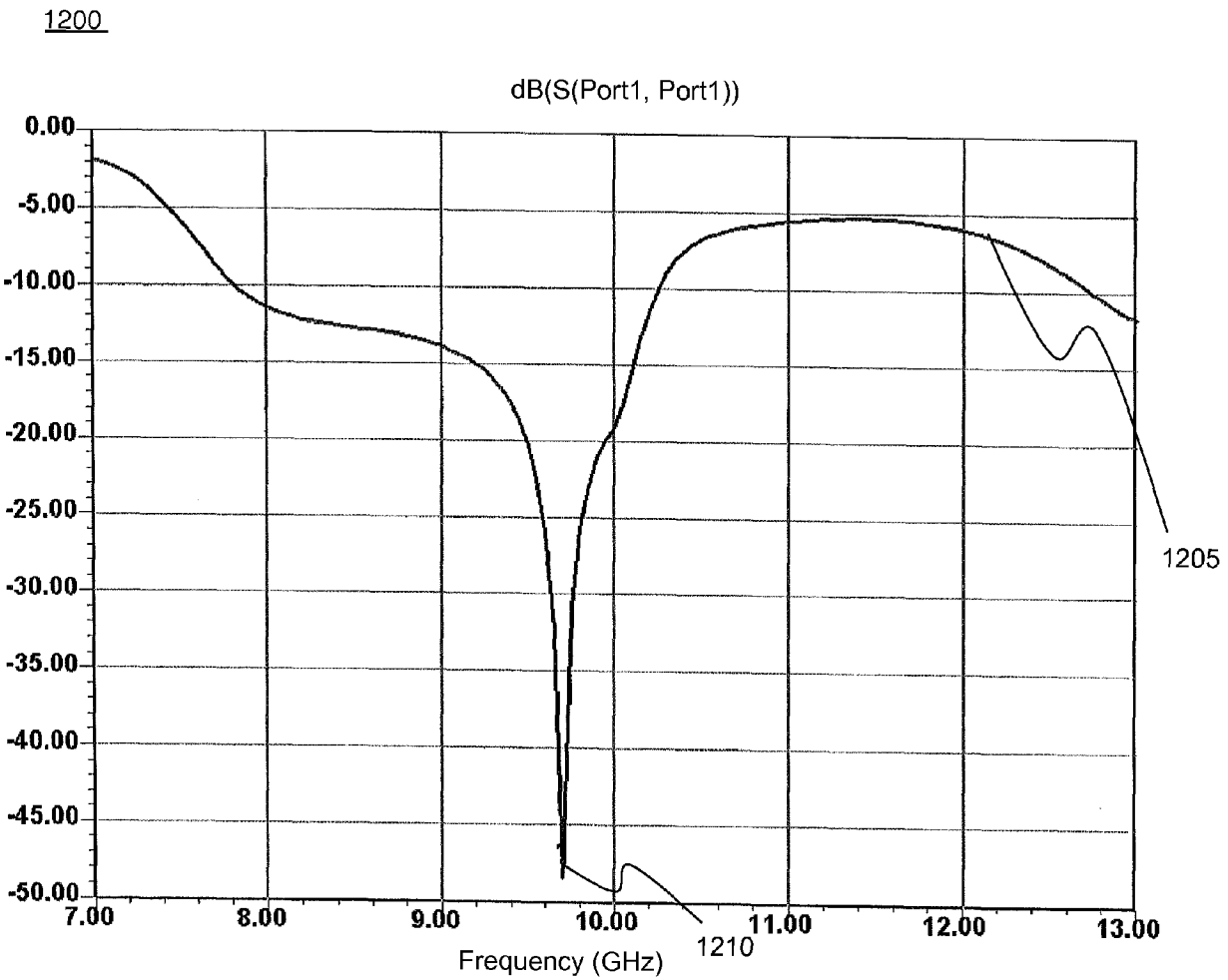
FIG. 12 is a graph of the modeled return loss of the turnstile antenna of FIG. 11.

FIG. 12 is a graph 1200 of the modeled return loss of the antenna of FIG. 11. It is a plot 1205 of dB(S(Port1, Port1)) over 7 to 13 GHz. Datapoint 1210 is at 9.70 GHz and −48.39 dB. This gives a remarkable VSWR result of 1.01:1.

Figure 13:
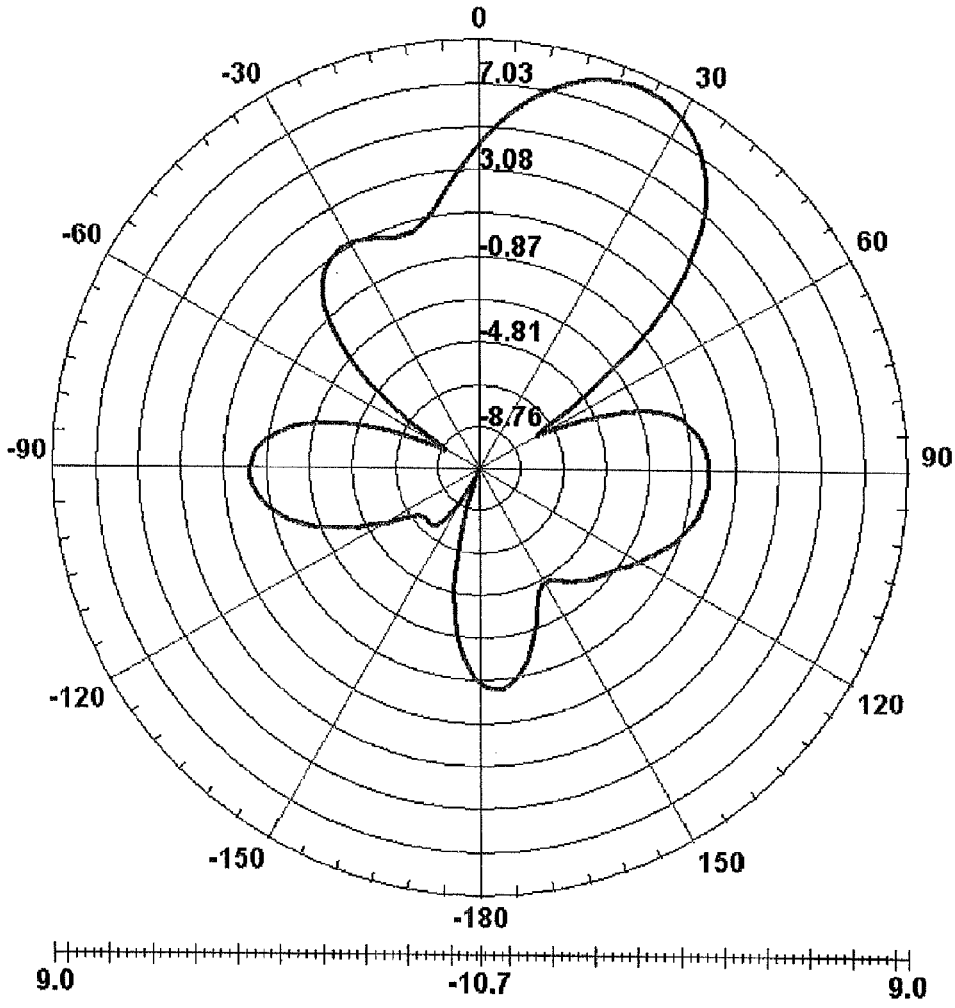
FIG. 13 is a polar plot of the antenna pattern for the antenna of FIG. 11.

FIG. 13 is a polar plot of the antenna pattern for the antenna embodiment of FIG. 11. It displays a farfield directivity radiation pattern for a frequency of 9.65 GHz, and phi=90 degrees.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A microwave turnstile antenna comprising:

a ground plane; and a pair of crossed dipole wire elements having a spacing from said ground plane and said elements fed 90 degrees out of phase; and a length of U-shaped coaxial cable in electrical connection between dipole wire elements of said pair of crossed dipole wire elements.

2. The antenna of claim 1, wherein the radiation polarization is horizontal.

3. The antenna of claim 1, wherein the radiation pattern provides transmit and receive reciprocity.

4. The antenna of claim 1, wherein the radiation pattern is substantially omnidirectional in the plane of said ground plane.

5. The antenna of claim 1, wherein radiation is circularly polarized.

6. The antenna of claim 1, wherein radiation is in the X-band.

7. The antenna of claim 6, wherein resonant frequency is 9.5 GHz to 9.8 GHz.

8. The antenna of claim 1, wherein said spacing from said ground plane is one-half wavelength.

9. The antenna of claim 1, wherein said spacing from said ground plane is 0.611 inch.

10. The antenna of claim 1, wherein length of said crossed dipole elements is one-half wavelength.

11. The antenna of claim 10, wherein said length of said crossed dipole elements is 0.7 inch.

12. The antenna of claim 1, wherein said ground plane comprises a copper disk.

13. The antenna of claim 1, wherein said ground plane is proximate a skirt.

14. The antenna of claim 13, wherein said ground plane diameter is 1.4 inches.

15. The antenna of claim 1, wherein said length of U-shaped piece of coaxial cable between said two dipoles is selected to produce circularly polarized (CP) radiation.

16. A horizontally polarized X-band turnstile antenna comprising:

a 1.4 inch diameter copper ground plane proximate a skirt;

a pair of crossed dipole elements 0.6375 inch long having a spacing 1.155 inches from said ground plane opposite said skirt, said dipole elements having 90 degree phasing; and a 0.66 inch long segment of U-shaped coaxial cable in electrical connection between said dipole elements.

17. A microwave frequency tag comprising: an antenna comprising:

a ground plane;

a pair of crossed wire element dipoles spaced from said ground plane and having 90 degree phasing;

a segment of U-shaped coaxial cable in electrical connection between wire dipole elements of said crossed wire element dipoles; and circuitry in electrical communication with said antenna wherein said microwave frequency tag communicates with a transceiver.

18. The microwave frequency tag of claim 17, wherein said tag is associated with personnel.

19. The microwave frequency tag of claim 17, wherein said tag is associated with vehicles.

20. The microwave frequency tag of claim 17, wherein said tag is a digital radio frequency tag (DRaFT).

* * * * *